US005775676A

United States Patent [19]

Hoggan

[11] Patent Number: 5,775,676

[45] Date of Patent: Jul. 7, 1998

[54] SELF-LOCKING SLATS WITH FINS FOR CHAIN LINK FENCES

[75] Inventor: Jefrey A. Hoggan, River Heights, Utah

[73] Assignee: Plastics Resources, Inc., River Heights, Utah

[21] Appl. No.: 804,223

[22] Filed: Feb. 21, 1997

[51] Int. Cl.[6] ..... B21F 27/00

[52] U.S. Cl. ..... 256/34; 256/32

[58] Field of Search ..... 256/34, 32–35, 256/24, 19, 48

[56] References Cited

U.S. PATENT DOCUMENTS

| | | | |
|---|---|---|---|
| 338,818 | 3/1886 | Ebaird | 256/34 |
| 2,892,647 | 6/1959 | O'Neill | 287/58 |
| 2,954,964 | 10/1960 | O'Haffey | 256/34 |
| 3,227,423 | 1/1966 | De Matteo | 256/12.5 |
| 3,712,590 | 1/1973 | Tochner et al. | 256/34 |
| 3,958,794 | 5/1976 | Suprunuk et al. | 256/34 |
| 4,343,567 | 8/1982 | Sarver et al. | 404/10 |
| 4,570,906 | 2/1986 | Walden | 256/34 |
| 4,723,761 | 2/1988 | Cluff | 256/34 |
| 4,860,998 | 8/1989 | Snyder | 256/34 |
| 4,950,098 | 8/1990 | Abbott et al. | 256/34 |
| 5,007,619 | 4/1991 | Sebini | 256/34 |
| 5,184,801 | 2/1993 | Finkelstein | 256/34 |
| 5,584,468 | 12/1996 | Meglino et al. | 256/34 |
| 5,687,957 | 11/1997 | Finkelstein | 256/34 |

FOREIGN PATENT DOCUMENTS

| | | | |
|---|---|---|---|
| 2476736 | 8/1981 | France | 256/34 |

*Primary Examiner*—Harry C. Kim
*Attorney, Agent, or Firm*—Holme Roberts & Owen

[57] ABSTRACT

A slat for use in chain link fences is provided. The slat generally includes an elongated, imperforate body member and first and second fins extending from the body member to provide privacy and to lock the slat within a channel of a chain link fence. The first and second fins include end legs which are configured and oriented to extend proximally and distally, respectively, relative to the body member toward fins of adjacently positioned slats to provide privacy. Further, the first and second fins are configured and oriented to extend into knuckles of a chain link fence, to wedge into the knuckles to secure the slats within the channels of the chain link fence. The fins may also include strands on the end legs which are capable of wrapping about the knuckles to lock the slats within the channels.

16 Claims, 4 Drawing Sheets

SELF-LOCKING SLATS WITH FINS FOR CHAIN LINK FENCES

FIELD OF THE INVENTION

The present invention generally relates to chain link fences, and in particular, to slats for use in chain link fences.

BACKGROUND OF THE INVENTION

As noted in commonly assigned U.S. Pat. No. 4,860,998 entitled "Slatted Chain Link Fence Construction, Slats Therefor, and Method of Slat Installation," chain link fences are typically constructed from an open, wire mesh fencing fabric which is woven diagonally so that alternate links zig-zag vertically and lie in different planes. Such links form knuckles or weaves in which the wire forming such knuckles twists about the wire that forms laterally adjoining links. In this regard, laterally adjoining channels are formed by vertically and diagonally along the height of a chain link fence constructed from wire mesh fencing fabric and such channels are open at their opposite (e.g., top and bottom) ends. As such fencing mesh is not closely woven, it does not conceal from view anything on either side of the chain link fence.

As further noted in U.S. Pat. No. 4,860,998, efforts have been made to obtain a degree of privacy by inserting slats of wood, aluminum or plastic into adjoining channels of the chain link fence, either vertically or diagonally. However, because of the knuckles and the inherent twisting forces generated by chain link fences, which warps some slats, complete concealment and easy installation has been difficult to achieve.

SUMMARY OF THE INVENTION

Accordingly, it is an object of the present invention to provide slats for use in a chain link fence to provide privacy at all visible angles.

It is another object of the present invention to provide a slat which is easily installable within channels of a chain link fence.

A further object of the present invention is to provide a slat for use in chain link fences which is self-locking.

Yet another object to the present invention is to provide a slatted chain link fence having self-locking slats installed therein.

The above objects of the present invention can be fulfilled by providing a slat having at least first and second fins which extend from a body member, the first and second fins being configured and oriented to facilitate installation/insertion of such slats into channels of a chain link fence and to provide privacy, windstopping capability and decorativeness, while being capable of locking the slat within a channel formed in a chain link fence. In one embodiment, privacy, windstop, decorative and ease of installation characteristics are achieved by providing first and second fins with end legs which extend at least distally and proximally, respectively, relative to the body member, such that the end legs of the first and second fins extend toward knuckles of the chain link fence and toward the correspondingly configured and oriented end legs of adjacently positioned slats of the present invention. The end legs of the first and second fins may also be configured and oriented parallel to each other, such that the end legs of the first and second fins extend toward and are parallel with the corresponding fins of adjacently positioned slats of the present invention. To further enhance privacy and the self-locking features of the slat of the present invention, the first and second fins and in particular, the end legs of the first and second fins define a slat width which is at least as wide as and, in a preferred embodiment is greater than, the width of the channels of the chain link fence, as defined by the opposing knuckles of the chain link fence.

In another embodiment, for purposes of enhancing the self-locking characteristics to the slats of the present invention, the end legs of the first and second fins include a plurality of flexible niches or strands which are capable of engaging the knuckles of the chain link fence to secure the slats therein. The strands of the end legs of the first and second fins are capable of wrapping about and relaxing about the knuckles of the chain link fence to thereby assist in locking each slat within a channel.

In another aspect, the present invention is directed to a method for making a slatted chain link fence having self-locking slats already installed within the channels of the chain link fence. Generally, the method includes weaving a chain link fence from a wire mesh fencing fabric and repeatedly inserting into each of the channels through open ends of the channels self-locking slats. By utilizing the self-locking slats of the present invention, an additional step of mechanically locking each slat to the wire mesh fencing fabric after installation is obviated. In this regard, the method of the present invention provides an efficient method of making slatted chain link fences.

In one embodiment, the step of repeatedly inserting self-locking slats into channels of a woven chain link fence includes the step of aligning at least one self-locking slat with at least one channel in the chain link fence. The inserting steps may further comprise rollably engaging at least distal and proximal face sheets of the body member of the self-locking slat to push at least one self-locking slat into an opening of at least one of the channels of the chain link fence. Thereafter, the open ends (e.g., at the top and bottom of the chain link fence) may be tied off to secure the position of the slat within each channel and to allow the strands on the end legs of the first and second fins to relax about the knuckles of the chain link fence, thereby automatically locking each slat of the present invention within the chain link fence channel. The method may further include the step of rolling the slatted chain link fence about itself to facilitate storage and delivery of the slatted chain link fence.

DETAILED DESCRIPTION OF THE INVENTION

Figure 1:
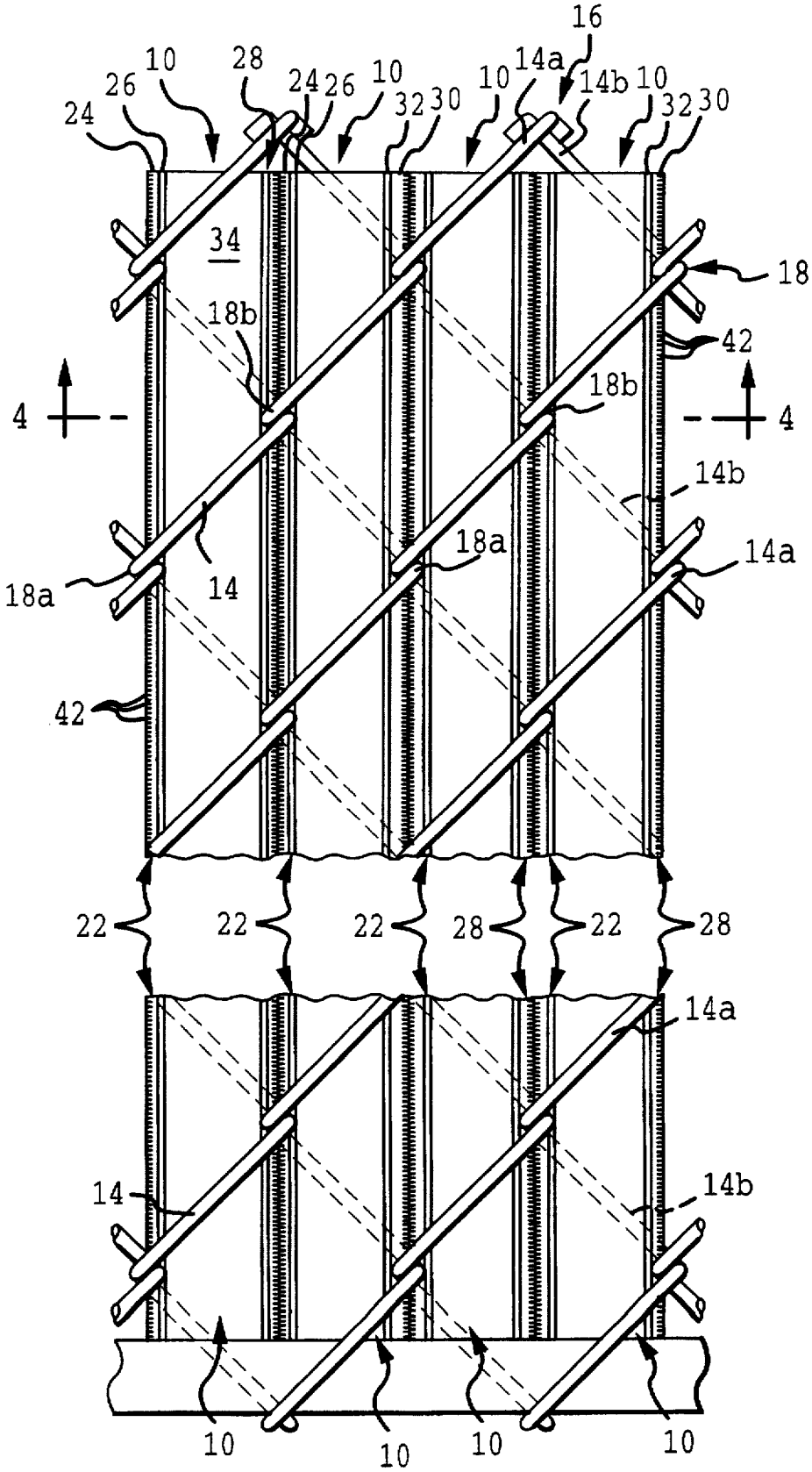
FIG. 1 is an elevational view of a chain link fence having slats of the present invention positioned therein, and intermediate portion being broken out for convenience for illustration.
Figure 2:
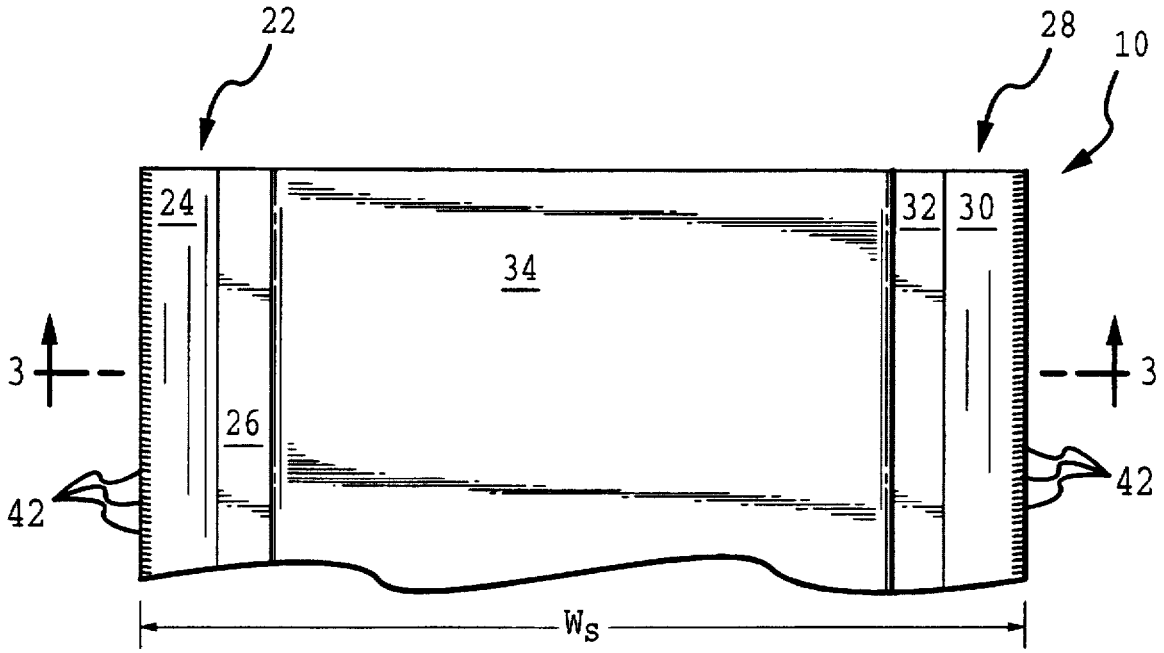
FIG. 2 is an elevational view of a front face of one of the slats of the present invention illustrated in FIG. 1.

The present invention is directed to a slat which is insertable within a channel of a chain link fence. Slats of the present invention generally comprise an elongated body member and first and second fins which extend from the body member. Such slats are insertable into channels of a chain link fence to provide privacy (e.g., to conceal from view things on either side of the chain link fence), a wind stopping capability, and to enhance decorativeness while locking or securing the slats within the channels. The channels of a chain link fence are typically defined by wire mesh fencing fabric of chain link fences and by a plurality of intermittently spaced, opposing weaves or knuckles at intersections of the wire mesh fencing fabric.

For ease of description, in the discussion of the slat 10 of the present invention, the term "distal" refers to the direction towards the back side of a chain link fence. Correspondingly, the term "proximal" refers to the direction toward the front side of a chain link fence.

FIGS. 1–4 illustrate the self-locking slats of the present invention. As illustrated, each slat 10 of the present invention is positional within a channel 12 of the wire mesh fencing fabric 14 of the chain link fence 16. Such channels 12 are typically defined by proximal and distal portions 14*a*, 14*b* of the wire mesh fencing fabric 14 and by opposing, intermittently spaced weaves or knuckles 18 at intersections of the wire mesh fencing fabric 14. In this regard, each of the slats 10 may be sized and configured to be insertable within each of the channels 12 of the chain link fence 16 while providing privacy and self-locking characteristics.

Figure 4:
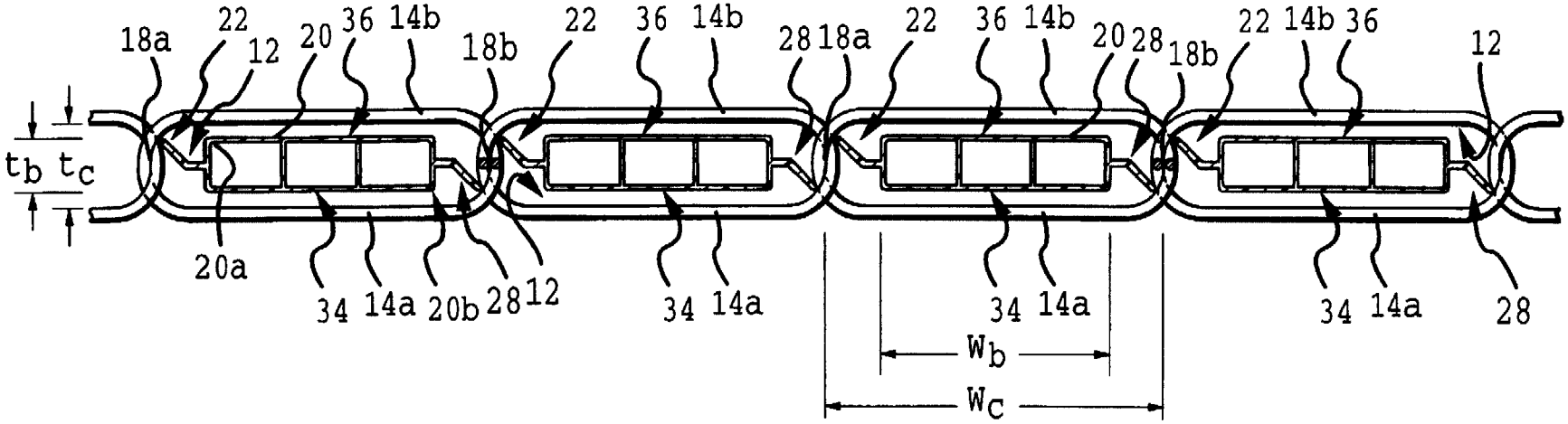
FIG. 4 is a cross-sectional view taken along line 4—4 of FIG. 1 and drawn to a larger scale.

In one embodiment, the slats 10 include an elongate body member 20 and first and second fins 22, 28 extending from the body member 20. For purposes of providing at least privacy and windstopping capability, the first and second fins 22, 28 are configured and oriented toward fins of adjacently positioned slats 10 of the present invention and to extend into the knuckles 18 of the chain link fence 16. The first and second fins 22, 28 may each include portions which extend at least laterally outwardly to engage the knuckles 18 (e.g., 18*a*, 18*b*) of the chain link fence 16 and to extend toward corresponding portions of adjacently positioned fins 22, 28 of adjacently positioned slats 10, as illustrated in FIGS. 1 and 4. In this embodiment, the first fin 22 includes a laterally, outwardly extending intermediate leg 26 and further includes an end leg 24 which extends at least distally, relative to a proximal face sheet 34, to engage at least a first knuckle 18 (e.g., knuckle 18*a*). The second fin 28 includes a laterally, outwardly extending intermediate leg 32 and further includes an end leg 30 which extends from the body member 20 at least proximally, relative to a distal face sheet 36 of the body member 20, to engage at least a second knuckle 18 (e.g., knuckle 18*b*, opposite the first knuckle 18*a*). In this regard, the first and second fins 22, 28 of the slat 10 extend at least to the knuckles 18 of the chain link fence 16 and, in a preferred embodiment, extend toward corresponding fins of adjacently positioned slats 10 of the present invention, as illustrated in FIGS. 1 and 4, to minimize the gaps between adjacent slats 10. As such, a very high degree of privacy from any angle or vantage point is provided. In one embodiment of the slats 10 which are used in 3"×5" chain link fences, a width, $w_s$, of the slat 10 may vary from about 2.83 inches to about 2.87 inches, depending upon the height of the chain link fence 16 and/or upon whether the slats 10 are preinstalled by a manufacturer (as will be described in more detail hereinbelow relating to the method of the present invention) or installed privately. For example, for slats 10 which are preinstalled in 3"×5" chain link fences having a height less than 6 feet, the width, $w_s$, of each of the slats 10 is about 2.87 inches, and for such chain link fences having a height of greater than 6 feet, the width $w_s$, of each of the slats 10 is about 2.85 inches. For slats 10 which are to be privately installed in 3"×5" chain link fences having a height less than 6 feet, the width, $w_s$, of each of the slats 10 is about 2.85 inches, and for such chain link fences having a height of greater than 6 feet, the width $w_s$, of each of the slats 10 is about 2.83 inches.

Figure 3:
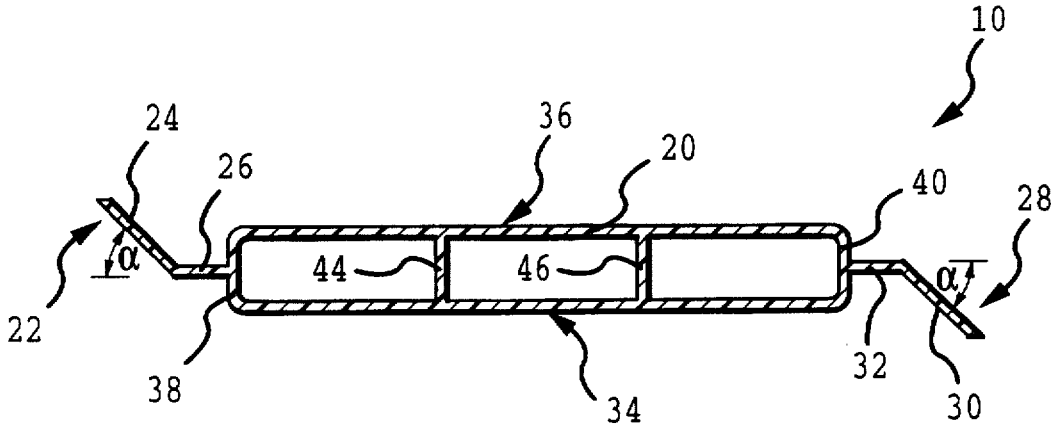
FIG. 3 is a cross-sectional view of the present invention taken along line 3—3 of FIG. 2.

For purposes of maximizing privacy while inhibiting rotational movement of these slats 10 within the channels 12 of the chain link fence 16, due to the inherent twisting forces of the chain link fence 16, the first and second distally and proximally extending fins 22, 28 may be configured and angled relative to the body member 20 to enable the first and second fins 22,28 to enter into the respective knuckles 18, to thereby wedge at least end portions of the end legs 24, 30 of the first and second fins 22, 28 within the knuckles 18. In one embodiment, the first and second fins 22, 28 are configured and angled relative to the body member 20, and specifically relative to intermediate legs 26, 32 of the first and second fins 22, 28 to enter into and be wedged within the knuckles 18, thereby providing the slat 10 with a means for positionally locking the slat 10 within a channel 12. In this regard, and as illustrated in FIG. 3, the first and second fins 22, 28 and specifically, the end legs 24, 30 of the first and second fins 22, 28 may be oriented at an angle $\propto$, relative to the intermediate legs 26, 32, to allow portions of at least one of the end legs 24, 30 to engage (e.g., enter into and wedge within) knuckles 18. In one embodiment, the end legs 24, 30 are oriented to extend distally and proximally, respectively, relative to the body member 20, and angled at an angle,$\propto$, of between about 35°, and about 55°, and more preferably between about 40° and 50°. In the illustrated embodiment, the intermediate legs 26, 32 of the first and second fins 22, 28, extend laterally outwardly from the body member 20, in a direction normal to sides 38, 40 of the body member 20. In this regard, the intermediate legs 26, 32 on the first and second fins 22, 28 are oriented about 90° relative to sides 38, 40 of the body member 20. Further, such configuration and orientation of the first and second fins 22, 28 of the slat 10 facilitates insertion of the slat 10 into a channel 12 of the chain link fence 16 as the fins 22, 28 of the slat 10 are configured and oriented to easily slide over the wire mesh fencing fabric and the knuckles 18.

To inhibit rotational movement of the slats 10 within the channels 12 while facilitating the insertability of the slats 10 into the channels 12, and to inhibit twisting of the chain link fence 12, the body member 20 may be configured such that portions of the body member 20 abuttingly engage at least one of the proximal and distal portions 14*a*, 14*b* of the wire mesh fencing fabric 14. In this regard, for right-hand woven chain link fences, a portion 20*a* of the body member 20 may abuttingly contact a segment of the distal portion 14*b* of the wire mesh fencing fabric 14, and a portion 20*b* of the body member 20 may abuttingly contact a segment of the proximal portion 14*a* of the wire mesh fencing fabric 14. The body member 20 may have-a thickness, $t_b$, illustrated in FIG. 4, which is less than the thickness, $t_c$, of the channel 12, as defined by the distance between the proximal and distal portions 14*a*, 14*b* of the wire mesh fencing fabric 14. In one embodiment, where the slats 10 are insertable within channels 12 of a 3"×5" chain link fence, the thickness, $t_b$, of the body member 20 of the slat 10 is about 0.25 inches. In this regard, the thickness, $t_b$, of the body member 20 of the slats 10 of the present invention is between about 40% and about 50% of the thickness, $t_c$, of channels 12 in a chain link fence (e.g., for industrial chain link fences, such as 3"×5" fences, 2"×4" etc.).

For purposes of further inhibiting rotational movement of the slats 10 within the channels 12 while facilitating the insertability of such slats 10 into the channels 12, and to inhibit twisting of the chain link fence 12, the width, $w_b$, of the body member 20 may be less than the width, $w_c$, of the channel 12, as defined by the distance between knuckles 18*a*, 18*b*, illustrated in FIG. 4. For right-hand woven chain link fences, the portion 20*a* of the body member 20 may abuttingly contact a segment of the distal portion 14*b* of the wire mesh fencing fabric 14, and the portion 20*b* of the body member 20 may abuttingly contact a segment of the proximal portion 14*a* of the wire mesh fencing fabric 14. In one embodiment, where the chain link fence 12 is a 3"×5" chain link fence having a width, $w_c$, of about 2.5 inches, the body member 20 may have a width, $w_b$, of about 2 inches. In this regard, the width, $w_b$, of the body member 20 of the slats 10 of the present invention may be between about 60% and about 90% of the width $w_c$, of the channels 12, and, in a preferred embodiment, is about 80% of the width $w_c$, of the channels 12 (e.g., for industrial chain link fences, such as 3"×5" fences, 2"×4" etc.).

For purposes of enhancing the locking characteristics of the slats 10 and to provide a self-locking slat, end legs 24, 30 of the first and second fins 22, 28 include, in another embodiment, a plurality of adjoining strands 42 for surrounding (e.g., wrapping about or enveloping) the knuckles 18 (e.g., knuckles 18*a*, 18*b*). End legs 24, 30 of the first and second fins 22, 28 may be transversely cut to provide strands 42 at the ends thereof. In one embodiment, where the slat 10 will be used for 3"×5" mesh chain link wire fences, the strands 42 have a length of at least about 0.10 inches and are spaced at least about 0.11 inches apart from each other along the length of the end legs 24, 30 of the first and second fins 22, 28, which extend longitudinally along and from the body member 20.

In one embodiment, for purposes of providing a lightweight, flexible slat 10 that may be efficiently installed in channels 12, the slat 10 is a flexible member which may be fabricated from a plastic material, such as a high or medium density polyethylene, a linear low density polyethylene (co-extruded), a polypropylene copolymer, ethyl-vinyl acetate or a low density polyethylene. As end portions of the first and second fins 22, 28 are received and wedged within knuckles 18, and are subject to tensile stresses, at least the first and second fins 22, 28 may be fabricated from these plastic materials and should have a tensile strength of at least about 1000 psi. In a preferred embodiment, the slats 10, and in particular the fins 22, 28, are fabricated from a plastic material having a tensile strength of at least about 2500 psi and, in yet another preferred embodiment, at least the fins 22, 28 are fabricated from a high density polyethylene having a tensile strength of about 4400 psi. The body member 20 is a hollow, imperforate member and includes proximal and distal face sheets 34, 36 and by first and second side members 38, 40. As illustrated in FIGS. 3 and 4, the body member 20 further includes, in one embodiment, first and second interior walls 44, 46. Such interior walls 44, 46 substantially inhibit buckling of the slat 10 as the slat 10 is inserted or installed within channels 12 of a chain link fence 16. In embodiments where the slat 10 is fabricated from a plastic material, such as high or medium density polyethylene, the interior walls 44, 46 have a thickness of at least about 0.3 inches (e.g., for slats 10 to be installed in 3"×5" mesh chain link).

In another aspect, the present invention is directed to a method for making a slatted chain link fence by utilizing the self-locking slats 10 disclosed hereinabove. Generally, the method includes the steps of weaving a chain link fence from a wire mesh fencing fabric to define a plurality of channels in the chain link fence and repeatedly inserting in each of the channels self-locking slats. As each of these slats 10 of the present invention insertable within the channels 12 of a chain link fence 16 are self-locking due to the plurality of strands 42 and the configurations and orientations of the end legs 24, 30 of the first and second fins 22, 28, a portion of which enables such end legs 24, 30 to be wedged within the knuckles 18, techniques for mechanically locking (e.g., stapling) each slat within the channels 12 of a chain link fence 16 are not needed.

Figure 5:
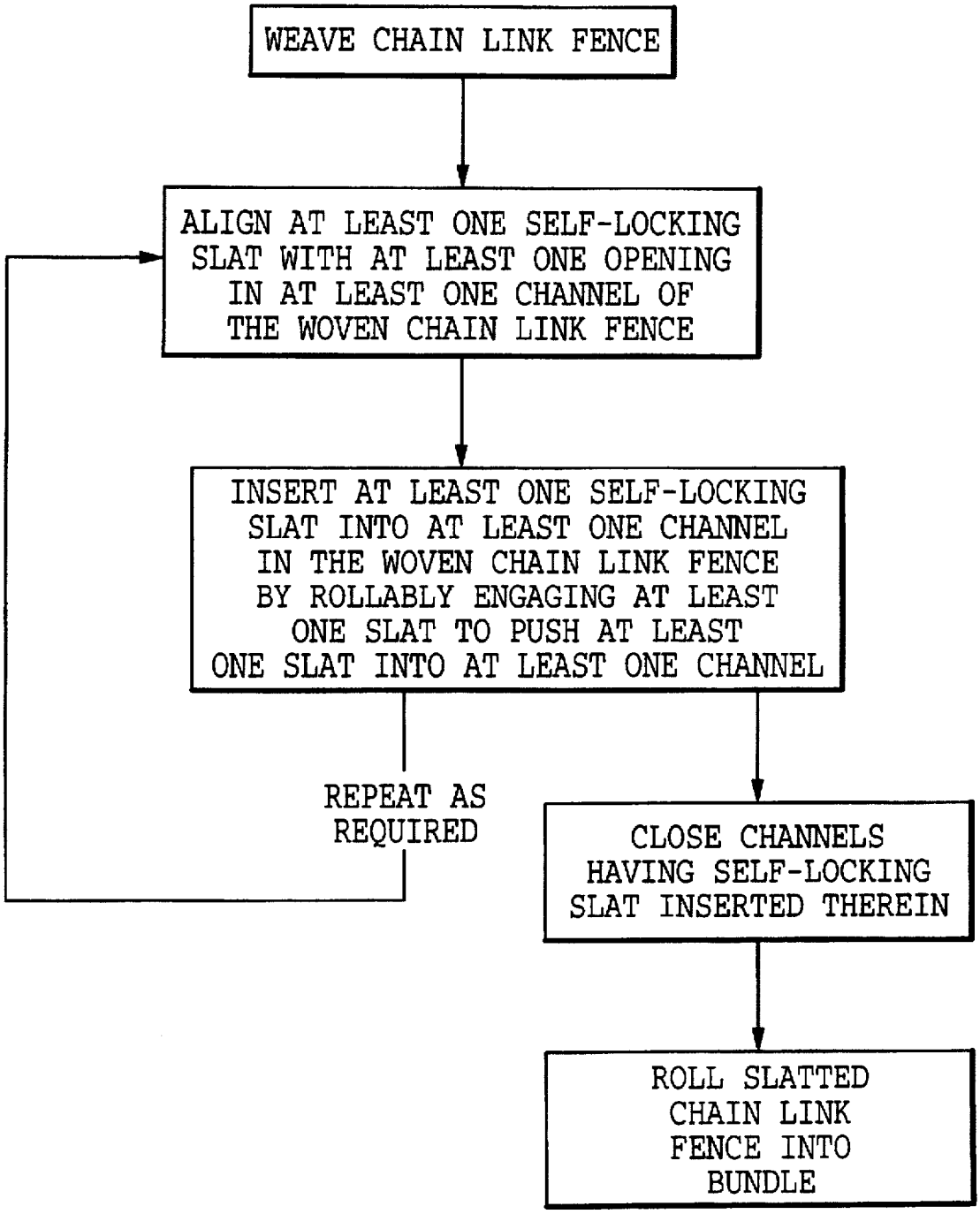
FIG. 5 is a flow chart illustrating one embodiment of a method for making a slatted chain link fence with self-locking slats of the present invention positioned therein.

Generally, and as illustrated in FIG. 5, the method of the present invention includes the steps of weaving a chain link fence having a plurality of channels defined by proximal and distal portions of wire mesh fencing fabric than by a plurality of intermittently spaced, opposing weaves or knuckles defined at intersections of the wire mesh fencing fabric, the opposing knuckles defining a channel width, and repeatedly inserting into each of the channels self-locking slats. In order to insert slats 10 into channels 12 of the chain link fence 16, which has been woven by machines and methods known to those skilled in the art, a device for pushing such slats 10 into open ends of each channel 12 may be utilized. In one embodiment, a machine available from Bregandi aligns at least one slat 10 with at least one of the open ends of channels 12 of a chain link fence such that the open ends of channels 12 are ready to receive therein a slat 10. The slats 10 are rollably engaged on at least the distal and proximate face sheets 34, 36 of a body member 20 to push at least one slat 10 into at least one corresponding channel 12 of the woven chain link fence 16. Each slat 10 includes first and second interior walls 44, 36 to inhibit buckling of slat 10 during insertion into the channel 12 of the chain link fence 16. A tie-off machine, known by those skilled in the art, may then be used to close off the openings of the channels 12 of the chain link fence 16 (e.g., top and bottom ends of the chain link fence 16). This procedure may be repeated until a desired number of slats 10 have been inserted into a correspondingly desired number of channels 12 of a chain link fence 16.

Once inserted into the channels 12 of the chain link fence 16, the self-locking slats 10 of the present invention automatically secured themselves to the knuckles 18 of the chain link fence 16 as the strands 42 attached to the end legs 24, 30 of the first and second fins 22, 28 relax in a wrapped around fashion about the knuckles 18 of the chain link fence 16 and portions of the end legs 24, 30 are wedged into the knuckles 18. Thereafter, for purposes of facilitating storage of a slatted chain link fence, the slatted chain link fence may be rolled about itself without unlocking the slats 10 locked therein.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described here and above are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A slat for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the opposing knuckles defining a width of the channel, said slat comprising:

an elongate, imperforate body member having distal and proximal face sheets, wherein said proximal and distal face sheets are parallel to each other and are interconnected by first and second sides of said body member, said first and second sides are adapted to correspond to the first and second opposing knuckles; and first and second fins extending from said body member, for locking said slat within the channel, wherein at least an end leg of said first fin extends at least distally, relative to said proximal face sheet of said body member, to engage at least a first knuckle, and an end leg of said second fin extends at least proximally, relative to said distal face sheet of said body member, to engage at least a second knuckle opposite the first knuckle, wherein said first and second fins further include intermediate leas extending between said first and second sides of said body member and said end leas of said first and second fins, respectively wherein said intermediate legs are oriented substantially parallel to said proximal and distal face sheets.

2. A slat, as claimed in claim 1, wherein said end legs of said first and second fins include a plurality of strands extending from said end legs of said first and second fins, said strands being capable of wrapping around at least the first and second knuckles, respectively, to lock said body member within the channel.

3. A slat, as claimed in claim 1, wherein said first and second fins are adapted to extend along and outwardly from longitudinal sides of said body member toward and into at least the first and second knuckles, respectively, said first and second fins defining a first width of said slat, said first width of said slat is adapted to be at least about the channel width to wedge portions of said first and second fins within the first and second knuckles.

4. A slat, as claimed in claim 1, wherein said intermediate legs of said first and second fins are oriented normal to said body member and are adapted to extend at least toward the first and second knuckles.

5. A slat, as claimed in claim 1, wherein at least a segment of at least one of said proximal and distal face sheets is abuttingly engageable with at least one of the proximal and distal portions of the wire mesh fencing fabric to inhibit rotation of said slat within the channel of the chain link fence.

6. A slat, as claimed in claim 1, wherein said first and second fins include a plurality of strands on said end legs of said first and second fins, said strands for wrapping about said knuckles to lock said slat within said channel.

7. A slat, as claimed in claim 1, wherein said first and second fins are fabricated from a plastic material selected from the group consisting of high density polyethylene, medium density polyethylene, linear low density polyethylene polypropylene copolymers, ethyl-vinyl acetate and low density polyethylene.

8. A slat, as claimed in claim 1, wherein said body member is hollow and includes at least one wall extending between said distal and proximal face sheets.

9. A slat, as claimed in claim 8, wherein said body member includes a two laterally spaced apart walls extending between said distal and proximal face sheets.

10. A slat, as claimed in claim 1, wherein at least a segment of at least one of said proximal and distal face sheets of said body member is abuttingly engageable with at least one of proximal and distal portions of said wire mesh fencing fabric to inhibit rotation of said slat said channel.

11. A slate for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the opposing knuckles defining a width of the channel, said slat comprising:

an elongate, imperforate body member having distal and proximal face sheets; and first and second fins extending from said body member, for locking said slat within the channel, wherein at least an end leg of said first fin extends at least distally, relative to said proximal face sheet of said body member, to engage at least a first knuckle, and an end leg of said second fin extends at least proximally, relative to said distal face sheet of said body member, to engage at least a second knuckle opposite the first knuckle, wherein said first and second fins further include intermediate legs extending between said body member and said end legs of said first and second fins, wherein said end leg of said first fin is oriented between about 35° and about 55° relative to said intermediate leg of said first fin to extend at least distally, relative to said proximal face sheet of said body member.

12. A slat for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the opposing knuckles defining a width of the channel, said slat comprising:

an elongate, imperforate body member having distal and proximal face sheets: and first and second fins extending from said body member, for locking said slat within the channel, wherein at least an end leg of said first fin extends at least distally, relative to said proximal face sheet of said body member, to engage at least a first knuckle, and an end leg of said second fin extends at least proximally, relative to said distal face sheet of said body member, to engage at least a second knuckle opposite the first knuckle, wherein said first and second fins further include intermediate legs extending between said body member and said end legs of said first and second fins, wherein said end leg of said second fin is oriented between about 35° and about 55° relative to said intermediate leg of said second fin to extend at least proximally, relative to said distal face sheet.

13. A slat for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the opposing knuckles defining a width of the channel, said slat comprising:

an elongate. imperforate body member having distal and proximal face sheets; and first and second fins extending from said body member, for locking said slat within the channel, wherein at least an end leg of said first fin extends at least distally, relative to said proximal face sheet of said body member, to engage at least a first knuckle, and an end leg of said second fin extends at least proximally, relative to said distal face sheet of said body member, to engage at least a second knuckle opposite the first knuckle, wherein said first and second fins further include intermediate legs extending between said body member and said end legs of said first and second fins, wherein said end leg of said first fin is oriented between about 35° and about 55° relative to said intermediate leg of said first fin to extend at least distally, relative to said proximal face sheet, wherein said end leg of said second fin is oriented between about 35° and about 55° relative to said intermediate leg of said second fin to extend at least relative to said distal face sheet, wherein said end legs of said first and second fins are parallel to each other.

14. A slatted chain link fence comprising:

a chain link fence structure having wire mesh fencing fabric and channels defined by proximal and distal portions of the wire mesh fencing fabric and by a plurality of intermittently spaced, opposing knuckles at intersections of the wire mesh fencing fabric, the opposing knuckles defining a channel width; and a plurality of slats insertable in said channels, each slat including an elongate, imperforate body member having distal and proximal face sheets and at least first and second fins extending from said body member, wherein at least an end leg of said first fin extends at least distally, relative to said proximal face sheet of said body member, to wedgably engage at least a first knuckle, and an end leg of said second fin extends at least proximally, relative to said distal face sheet of said body member, to wedgably engage at least a second knuckle opposite said first knuckle, wherein said first and second fins further include intermediate legs extending between said body member and said end legs of said first and second fins, respectively, wherein said end leg of said first fin is oriented between about 35° and about 55° relative to said intermediate leg of said first fin to extend at least distally, relative to said proximal face sheet.

15. A slatted chain link fence comprising:

a chain link fence structure having wire mesh fencing fabric and channels defined by proximal and distal portions of the wire mesh fencing fabric and by a plurality of intermittently spaced, opposing knuckles at intersections of the wire mesh fencing fabric, the opposing knuckles defining a channel width; and a plurality of slats insertable in said channels, each slat including an elongate, imperforate body member having distal and proximal face sheets and at least first and second fins extending from said body member, wherein at least an end leg of said first fin extends at least distally, relative to said proximal face sheet of said body member, to wedgably engage at least a first knuckle, and an end leg of said second fin extends at least proximally, relative to said distal face sheet of said body member, to wedgably engage at least a second knuckle opposite said first knuckle, wherein said first and second fins further include intermediate legs extending between said body member and said end legs of said first and second fins, respectively, wherein said end leg of said second fin is oriented between about 35° and about 55° relative to intermediate leg of said second fin to extend at least proximally, relative to said distal face sheet.

16. A slatted chain link fence comprising:

a chain link fence structure having wire mesh fencing fabric and channels defined by proximal and distal portions of the wire mesh fencing fabric and by a plurality of intermittently spaced, opposing knuckles at intersections of the wire mesh fencing fabric, the opposing knuckles defining a channel width; and a plurality of slats insertable in said channels, each slat including an elongate, imperforate body member having distal and proximal face sheets and at least first and second fins extending from said body member, wherein at least an end leg of said first fin extends at least distally, relative to said proximal face sheet of said body member, to wedgably engage at least a first knuckle, and an end leg of said second fin extends at least proximally, relative to said distal face sheet of said body member, to wedgably engage at least a second knuckle opposite said first knuckle, wherein said first and second fins further include intermediate legs extending between said body member and said end legs of said first and second fins, respectively, wherein said end leg of said first fin is oriented between about 35° and about 55° relative to said intermediate leg of said first fin to extend at least distally, relative to said proximal face sheet, wherein said end leg of said second fin is oriented between about 35° and about 55° relative to said intermediate leg of said second fin to extend at least proximally, relative to said distal face sheet, wherein said end legs of said first and second fins are parallel.

* * * * *

UNITED STATES PATENT AND TRADEMARK OFFICE

CERTIFICATE OF CORRECTION

PATENT NO. : 5,775,676

DATED : July 7, 1998

INVENTOR(S) : HOGGAN, Jefrey A.

It is certified that error appears in the above-identified patent and that said Letters Patent is hereby corrected as shown below:

Column 7, Claim 1, line 22, the text "leas" has been amended to read –legs–;
Column 8, Claim 13, line 60, the text "." has been amended to read –,–;
Column 9, Claim 13, line 12, following the text "at least", the text –proximally,– has been inserted;
Column 9, Claim 14, line 30, the text "." has been amended to read –,–.

Signed and Sealed this

Fifteenth Day of September, 1998

*Attest:*

*Attesting Officer*

Bruce Lehman

BRUCE LEHMAN

*Commissioner of Patents and Trademarks*